US007960666B2

(12) United States Patent
Curnis et al.

(10) Patent No.: US 7,960,666 B2
(45) Date of Patent: Jun. 14, 2011

(54) LOW-VOLTAGE CIRCUIT BREAKER WITH INTERCHANGEABLE POLES

(75) Inventors: Maurizio Curnis, Carvico (IT); Federico Gamba, Bergamo (IT)

(73) Assignee: ABB S.p.A., Milan (IT)

( * ) Notice: Subject to any disclaimer, the term of this patent is extended or adjusted under 35 U.S.C. 154(b) by 484 days.

(21) Appl. No.: 11/867,048

(22) Filed: Oct. 4, 2007

(65) Prior Publication Data

US 2008/0246563 A1 Oct. 9, 2008

(30) Foreign Application Priority Data

Oct. 6, 2006 (IT) ..... BG2006A0050

(51) Int. Cl.
*H01H 3/00* (2006.01)

(52) U.S. Cl. ..... 200/400; 200/50.32

(58) Field of Classification Search ..... 200/50.32–50.4, 200/400, 401, 500, 501, 303
See application file for complete search history.

(56) References Cited

U.S. PATENT DOCUMENTS

| | | | | |
|---|---|---|---|---|
| 3,908,106 | A * | 9/1975 | Hirasawa et al. | 200/82 B |
| 4,764,650 | A * | 8/1988 | Bur et al. | 200/564 |
| 4,950,854 | A * | 8/1990 | Green | 218/118 |
| 5,483,211 | A * | 1/1996 | Carrodus et al. | 335/18 |
| 5,726,852 | A * | 3/1998 | Trifiletti et al. | 361/115 |
| 6,005,207 | A * | 12/1999 | DiMarco et al. | 200/303 |
| 6,541,719 | B1 * | 4/2003 | Powell | 200/50.32 |
| 6,597,266 | B1 * | 7/2003 | Rodriguez et al. | 335/132 |
| 6,680,842 | B1 * | 1/2004 | Pelaez et al. | 361/631 |
| 2002/0153978 | A1 * | 10/2002 | Greenberg et al. | 335/8 |
| 2003/0001701 | A1 * | 1/2003 | Bach et al. | 335/9 |
| 2006/0120026 | A1 * | 6/2006 | Wiant et al. | 361/614 |

FOREIGN PATENT DOCUMENTS

| | | | |
|---|---|---|---|
| EP | 0079819 | A1 | 5/1983 |
| EP | 0179677 | A1 | 4/1986 |
| EP | 0859387 | | 8/1998 |
| FR | 258925 | A1 | 5/1987 |
| JP | 07026897 | A | 1/1995 |

OTHER PUBLICATIONS

Communication with extended European Search Report dated Nov. 2, 2007 in counterpart Application No. EP 07116268.9.

* cited by examiner

*Primary Examiner* — Michael A Friedhofer
(74) *Attorney, Agent, or Firm* — Connolly Bove Lodge & Hutz LLP

(57) ABSTRACT

A low-voltage circuit breaker that comprises: a containment structure; a control mechanism; a plurality of circuit breaking poles, chosen between a first type of pole that comprises a first housing containing a first fixed contact and a corresponding first moving contact that can be coupled to said first fixed contact by means of its rotation around a point, and a second type of pole that comprises a second housing containing a second fixed contact and a corresponding second moving contact that can be coupled to said second fixed contact by means of a translatory movement along an axis; a first kinematic coupling between said control mechanism and said first moving contact, in the case of said poles belonging to said first type of pole, or a second kinematic coupling between said control mechanism and said second moving contact, in the case of said poles belonging to said second type of pole.

15 Claims, 10 Drawing Sheets

LOW-VOLTAGE CIRCUIT BREAKER WITH INTERCHANGEABLE POLES

FIELD OF THE INVENTION

The present invention relates to a low-voltage circuit breaker with improved characteristics of interchangeability of the current interrupting means as well as an easier maintenance and a greater flexibility in terms of its performance.

The term low-voltage circuit breaker is used equally to refer to both the so-called circuit breaker isolators and the automatic circuit breakers, the latter being devices for interrupting the electrical current that include safety devices that automatically open the contacts in the event of certain conditions of overload, short circuit or other electrical anomalies. In the description that follows, the term circuit breaker is consequently used to mean either an automatic circuit breaker or any other type of single-pole or multipole, low-voltage circuit breaking device (e.g. an isolator).

BACKGROUND OF THE INVENTION

It is common knowledge that each of the electrical poles of a circuit breaker comprises at least two electrodes for connecting to an electrical network and current interrupting means. Each of said current interrupting means comprises at least a pair of contacts suitable for acquiring at least two configurations, i.e. coupled and uncoupled.

The circuit breakers also comprise control means, hereinafter indicated for the sake of brevity by the term control, that establish the mutual coupling and uncoupling of said current interrupting means.

The control comprises propulsion means, such as springs or magnets, that provide the energy needed to couple and uncouple the current interrupting means in the poles, according to the methods required. In addition to the propulsion means, the control can comprise suitable control and drive kinematic chains (particularly shafts and/or sliding members, and/or connecting rods) placed between the propulsion means and the moving contacts of the respective poles.

The installer normally chooses a circuit breaker to suit the particular features of the loads and of the stretch of electrical network for which it is intended, using suitable calculations to formulate a set of performance requirements to be met. That is why manufacturers produce families of devices including various sizes, each of which is suitable for covering a particular range of characteristics.

The most common requirements for a circuit breaker can be summarised, using definitions known to a person skilled in the art, in the form of the so-called nameplate data or "specifications". The following are normally considered among the requirements for a circuit breaker: rated voltage (Ue), rated impulse withstand voltage (Uimp), rated current (Iu), breaking capacity in various conditions (Icu, Ics, Icw), making capacity (Icm), mechanical life, allowable frequency of operation, electrical endurance in standard conditions, proportional loss of electrical endurance after a short circuit, electrodynamic limiting capacity, insulation between the phases, etc.

The circuit breaker's performance depends on the combination of the characteristics of its constituent parts and particularly on those of the control and electric poles. The control provides the energy for contact opening and closing operations according to previously established methods, while the electrical poles—which include the contacts—are the essential means for creating and interrupting the current.

Much research has been done to improve the characteristics of the controls and electrical poles, both individually and as a whole. As a consequence, there are several varieties of said elements available today, each of which is characterised by specific advantages and disadvantages.

In particular, the manufacturer optimises and exploits the technologies available to produce families and sizes of circuit breakers capable of adequately covering the various performance combinations required for the various types of installation.

It is naturally impossible to have specific circuit breakers tailored to every particular performance combination required. Generally speaking, circuit breakers are chosen that have a slightly better performance than is strictly necessary, taking action to reduce or down-rate them where necessary (using a different calibration of the relays and current sensors, for instance). As it is easy to imagine, this procedure is fine for a modest down-rating, but it would not be cost effective to use appliances that are considerably over-dimensioned for the predicted real needs.

The known types of electrical pole are classifiable in at least two main families, which have become well established, i.e. the poles in free air and the so-called sealed poles, which have to be contained in a specific controlled environment.

The poles in free air are commonly used in moulded-case (MCCB) and air (ACB) circuit breaker devices and are characterised by the presence of the so-called arcing chambers in the vicinity of the contacts. The arcing chambers place the area occupied by the active part of the contacts (where the electric current is created and interrupted) more or less directly in communication with the outside environment. See, for instance, EP0859387. The arcing chambers can comprise a variety of additional elements, described in more detail below. The poles in free air come in versions with single or multiple (e.g. double) current interrupting capabilities. The way in which the contacts move may also vary, being rotatory, translatory or a combination of the two.

The sealed poles are commonly used in high-voltage devices and are normally characterised by the presence of sealed ampoules or chambers surrounding the area of the contacts (where the electrical current is created and interrupted), preventing any free communication between the contacts and the outside environment. Sealed poles are also classifiable in two categories. The first type comprises the so-called vacuum poles, which operate in a severely rarefied atmosphere consisting of known gases; the second type comprises poles in an arc-extinguishing gas, in which case the sealed chamber contains specific gases or gaseous mixtures at a known pressure. Unlike the poles in free air, the sealed poles do not have channels directly communicating with the outside environment, which would be incompatible with their characteristics of air tightness.

It is easy to imagine that the presence or absence of a normal atmosphere in the contact area for the free-air or sealed types of pole gives rise to very different operating conditions.

In particular, the poles in free air must be designed particularly so that they avoid facilitating the formation and so that they instead facilitate the extinction of any electrical and plasma arcs that are well known to be supported by the presence of oxygen and other gases commonly occurring in the normal atmosphere. For this purpose, to ensure the proper operation of the poles in free air, especially when it comes to interrupting high currents, a considerable gap (or extended stroke) must be rapidly created between the active areas of the contacts. Other known optional devices, such as deflectors, foils, filters and gasifying means, can be connected to the arcing chamber to help extinguish the electrical arc, e.g. by diverting the arc towards the areas far from the contacts, absorbing thermal energy, and facilitating the de-ionisation of the plasma and the outflow of gases and filtrates from the circuit breaker, after their residual aggressiveness has been reduced as far as possible.

Given the substantial absence of air or ionisable gases in the area of the contacts, sealed poles operate in very different conditions. In fact, this situation determines a more or less marked immunity to the formation of electrical arcs in the area where the electrical current is interrupted, even when high currents are interrupted are during short circuits, offering the advantage of a perfect operation even with relatively small displacements between the contacts (i.e. a reduced stroke). On the other hand, for sealed poles it is essential to guarantee that the controlled environment (the positive or negative relative pressure tightness) is maintained. Sealed poles also have the advantage of producing virtually no ionised gas emissions or high temperatures in the outside environment, thereby substantially preventing any risk of fire or contamination of the surrounding environment or other parts or accessories of the circuit breaker or other equipment in the vicinity (e.g. the electric switchboard containing the breaker, or other devices installed on the board).

Specifically to support the above-described different electrical and physical principles, which distinguish the operation of circuit breakers with poles in air from that of circuit breakers with sealed poles, and particularly the different needs concerning the relative displacement between the contacts in the closed and open (or tripped) positions, two separate families of controls have also been developed and become well-established, i.e. the so-called controls for poles in free air and the so-called controls for sealed poles. In particular, the controls for poles in free air are of the so-called extended-stroke type, while the controls for use with sealed poles are of the so-called reduced-stroke type.

The most obvious difference between these two types of control consists in the different extent of the stroke that they must impose on the moving contacts in order to complete a circuit breaking operation. Said stroke is normally induced by the combined movement of a main shaft and a suitable intermediate operative connection member (e.g. a connecting rod) between the shaft and the moving contacts.

Another clear difference between the known controls for poles in free air and those for sealed poles concerns the direction of the movement imposed on the moving contacts: it is usually substantially horizontal in circuit breakers with poles in free air and substantially vertical in circuit breakers with sealed poles.

Another natural difference between the two types of control concerns the different dielectric conditions and needs, and the presumable presence or absence of electrical arcs in the vicinity of the poles.

Depending on the type of electrical pole chosen for a given circuit breaker, it becomes necessary to design a corresponding control that is capable of ensuring the circuit breaker's operation, guaranteeing the level needed for each of the declared performance requirements.

In short, the control must be compatible with the constraints and demands relating to the kinematic, dynamic, energetic and dielectric isolation features that, depending on the type of pole chosen, may differ in each case, and may even be in contrast with one another.

The different dielectric demands for poles in free air and sealed poles also entail different choices concerning the materials used; for instance, insulating materials are used to make the arc extinguishing chambers of circuit breakers in free air, while a metal is typically chosen for the ampoules (or sealed chambers) destined for use in circuit breakers with sealed poles.

From the point of view of performance, it has been demonstrated that, in low-voltage circuit breakers, overall size and manufacturing cost being equal, the poles in free air are generally preferable when an excellent short-circuit breaking and current limiting performance is needed, whereas sealed poles are preferred when a particularly prolonged and heavy working life is to be expected, and also for installations at sites with a aggressive atmosphere.

In conclusion, the different needs identified have given rise to consolidated, distinct design and manufacturing solutions for the controls, depending on whether they are destined for use in circuit breakers with poles in free air or with sealed poles.

The poles and the control generally constitute the most important and noble parts of a circuit breakers and must be perfectly compatible with one another. The synergy required between these two elements has led to an industrial approach in which the design and manufacture of circuit breakers with poles in free air or sealed poles are completely separate, specialised processes. This need for separation explains why manufacturers have traditionally foregone the chance to exploit even the marginal compatibility of the less noble and characteristic parts of a circuit breaker (such as the outer case, the accessories and the safety devices) in favour of a complete specificity of all the parts concerned.

In short, if a manufacturer wishes to produce ranges of circuit breakers both with poles in free air and with sealed poles—in order for instance to cover not only a wide range of certain specifications, but also different combinations of these specifications—then, according to the state of the art, the manufacturer is practically obliged to give up any opportunities to standardise component parts of the two families.

In particular, there are no devices available that belong to both types of family, or that offer any appreciable degree of mutual interchangeability between their component parts.

This manufacturing inflexibility is unavoidably translated into the practical need, for the manufacturer, to have separate design resources, technologies and production lines for the two types of circuit breaker and the related accessories, ultimately giving rise to economic costs that cannot fail to have a fallout on the final cost of the devices.

In addition to the economic problem, there is also a practical fallout for users of the two types of device, who are obliged to use separate ranges of accessories and store spare parts for both families of equipment.

SUMMARY OF THE INVENTION

The main technical aim of the present invention is to realise a circuit breaker that enables the above-described drawbacks to be overcome.

As part of this technical aim, one object of the present invention is to realise a circuit breaker that has improved characteristics for the purposes of industrial manufacturing standardisation in that it is capable, starting from a common basic version and by means of simple modifications, of acquiring the connotations of a device with poles in free air or of the type with sealed poles.

Another object of the present invention is to realise a circuit breaker with a standard control simultaneously capable of ensuring complete compatibility with both the so-called electrical poles in free air and the sealed electrical poles.

Another object of the present invention is to realise a circuit breaker in which the operative connection between the control and the poles is achieved by simple mechanical means capable of providing the power accumulated in the control in the form of parameters of force, movement and energy and suitable for electrical poles in free air in a first case, and for sealed electrical poles in a second case.

Another object of the present invention is to realise poles in free air or sealed poles that are perfectly compatible with the same control so that, on completion of the assembly, they can form complete and independent circuit breakers of one type or the other.

Another object of the present invention is to realise a circuit breaker that comprises a limited number of parts, and that is easy to assemble and install.

Another object of the present invention is to realise a circuit breaker with component parts that are easy to inspect, thus facilitating the servicing procedures.

Another object of the present invention is to realise a circuit breaker that is easy to convert from a first type with poles in free air to a second type with sealed poles, or vice versa, by replacing a very limited number of parts.

Another object of the present invention is to realise different ranges of circuit breakers belonging both to the type with poles in free air and to the type with sealed poles, compatible with a single range of common accessories (safety devices, breaking coils, making coils, interlocking systems, terminals, motor operators, fixed parts, cradles, etc).

Another object of the present invention is to realise a circuit breaker that is easy to convert from a first type with poles in free air to a second type with sealed poles, or vice versa, even for a person qualified in the sector using simple, standard equipment, and without the need for any calibration, fine adjustment or other such complex procedures.

Another object of the present invention is to realise a circuit breaker that enables considerable design, engineering and manufacturing synergies to be achieved with considerable consequent reductions in the manufacturing costs.

Another, not necessarily last object of the present invention is to realise a circuit breaker that is highly reliable and relatively easy to manufacture at a competitive cost.

Said technical aim and objects, as well as any other objects that emerge from the description that follows, are achieved by a low-voltage circuit breaker that comprises:

a containment structure:

a control mechanism;

a plurality of circuit breaking poles that are chosen between a first type of pole and a second type of pole; the first type of pole comprises a first housing containing a first fixed contact and a corresponding first moving contact that can be coupled with said first fixed contact by means of its rotation around a point, while the second type of pole comprises a second housing containing a second fixed contact and a corresponding second moving contact that can be coupled with said second fixed contact by means of a translatory movement along an axis;

a first kinematic chain for coupling said control mechanism to said first moving contact if the poles belong to said first type of pole, or a second kinematic chain for coupling said control mechanism to said second moving contact if said poles belong to said second type of pole.

In another aspect, the present invention also relates to a method for the assembly of a low-voltage circuit breaker that comprises the following stages:

preparing a containment structure for said circuit breaker;

preparing a control mechanism for said circuit breaker;

preparing a plurality of circuit breaking poles chosen between a first type of pole and a second type of pole; the first type of pole comprises a first housing containing a first fixed contact and a corresponding first moving contact that can be coupled with said first fixed contact by means of its rotation around a point, while the second type of pole comprises a second housing containing a second fixed contact and a corresponding second moving contact that can be coupled with said second fixed contact by means of a translatory movement along an axis;

preparing a first kinematic chain for coupling said control mechanism to said first moving contact;

preparing a second kinematic chain for coupling said control mechanism to said second moving contact;

placing said control mechanism and said plurality of poles inside said containment structure, mechanically connecting the control mechanism to the poles by means of said first kinematic coupling if the poles belong to said first type of pole, or by means of said second kinematic coupling if the poles belong to said second type of pole.

Thanks to the opportunity to use poles of different types, the circuit breaker according to the invention enables the problems typical of the circuit breakers of the known state of the art to be overcome. In particular, it is extremely easy to switch from one type of circuit breaker (e.g. with poles in free air) to another type of circuit breaker (e.g. with poles in a vacuum) simply by replacing the poles and entirely or partially replacing the kinematic coupling between the control mechanism and the poles.

For a better understanding of the present invention, reference is made to the accompanying drawings and to the detailed description hereinafter, in which preferred but non-limitative embodiments of the circuit breaker according to the present invention are illustrated.

DESCRIPTION OF THE PREFERRED EMBODIMENTS

Figure 1:
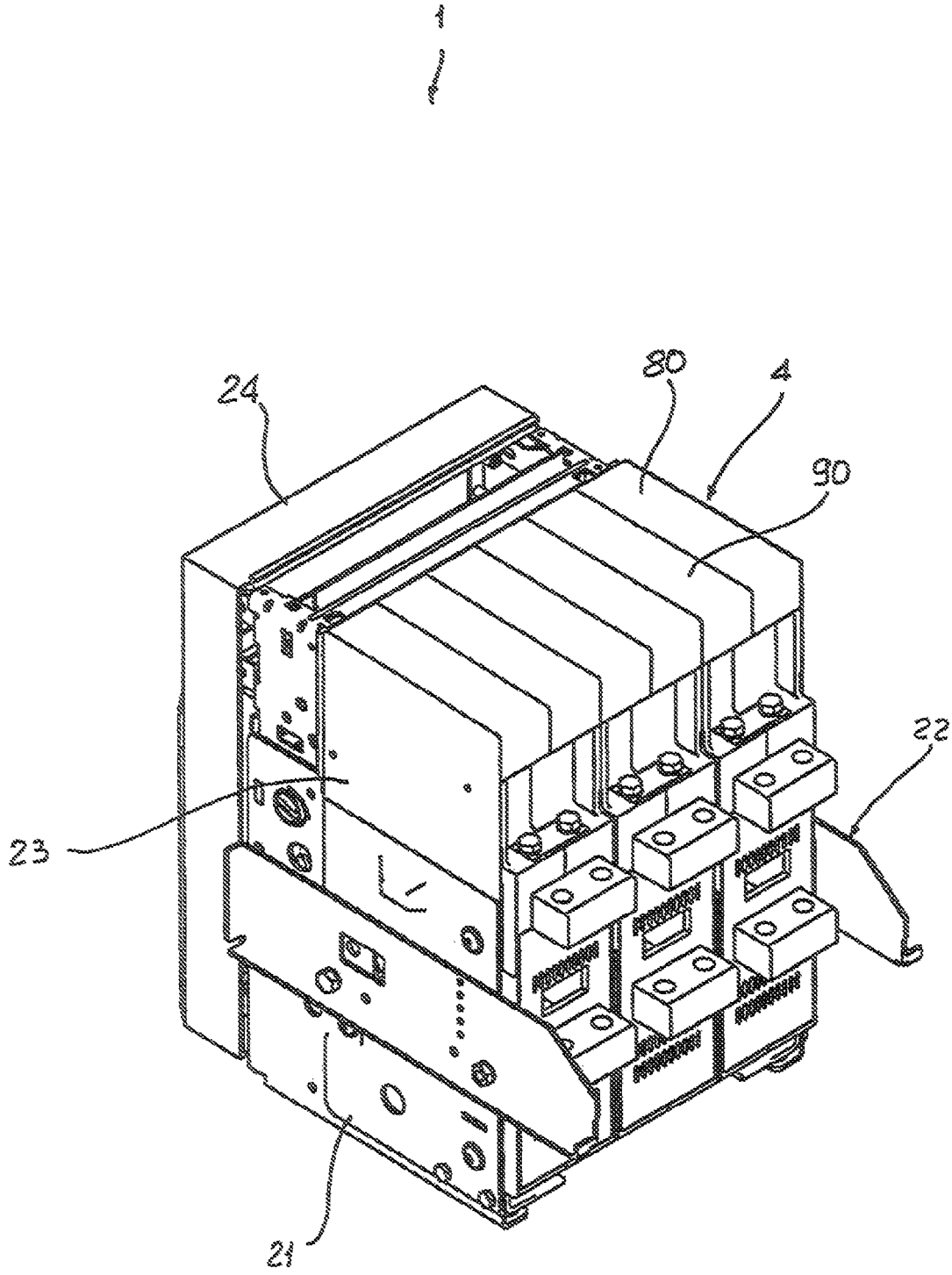
FIG. 1 is a perspective view of an assembled circuit breaker according to the invention.
Figure 2:
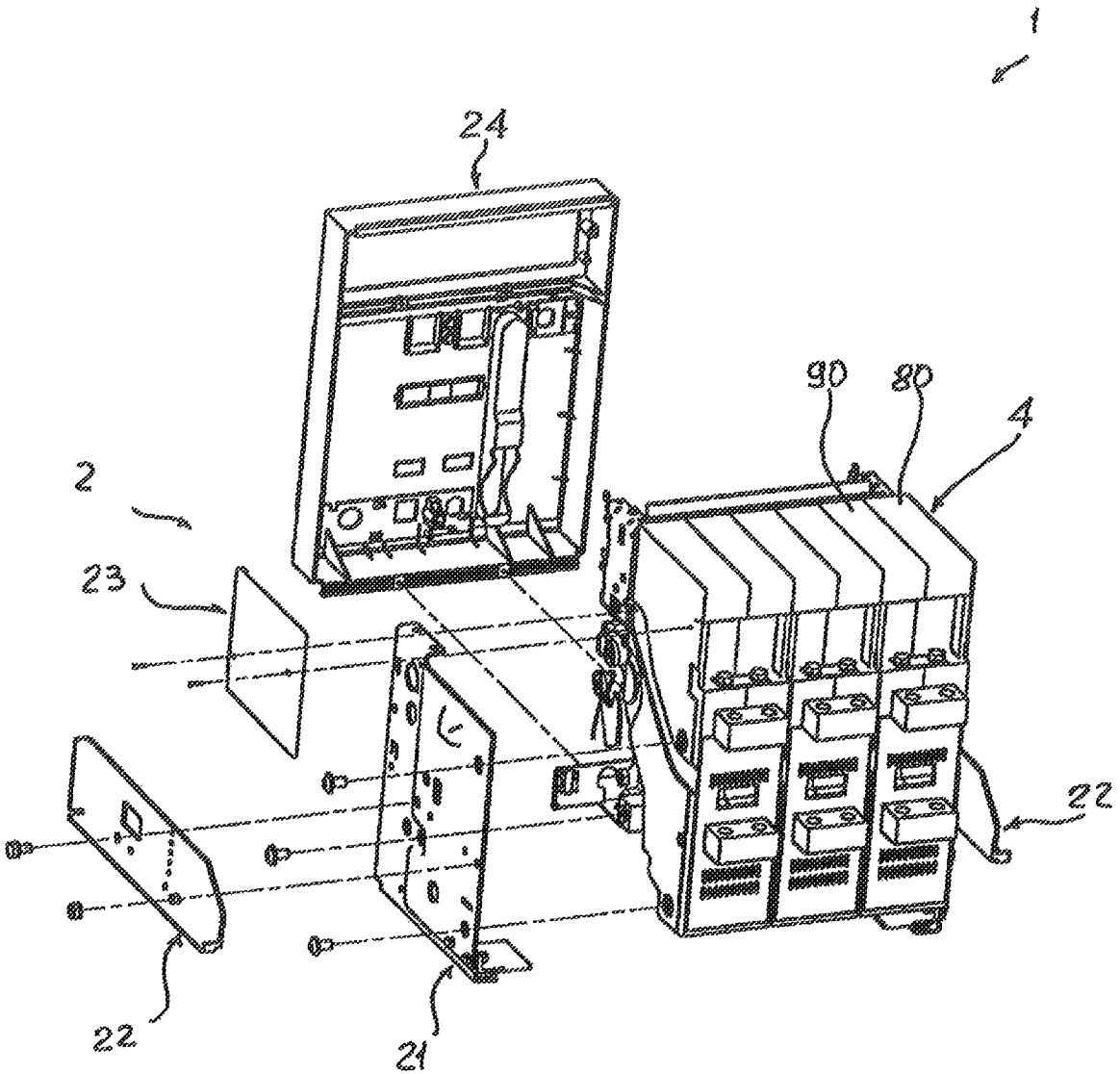
FIG. 2 is a partially exploded perspective view of a circuit breaker according to the invention.
Figure 3:
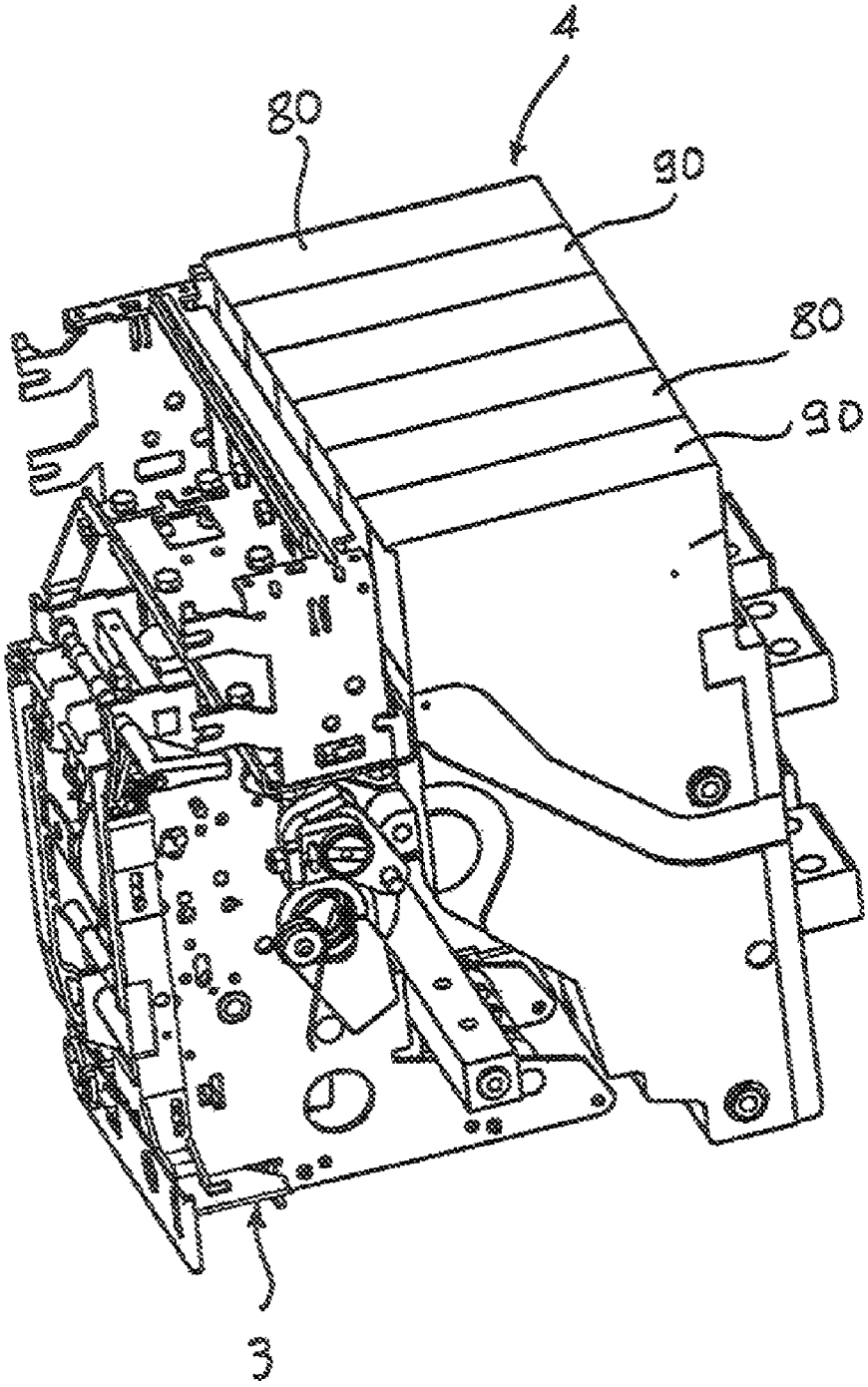
FIG. 3 is a perspective view of several details of a partially assembled circuit breaker according to the invention.
Figure 4:
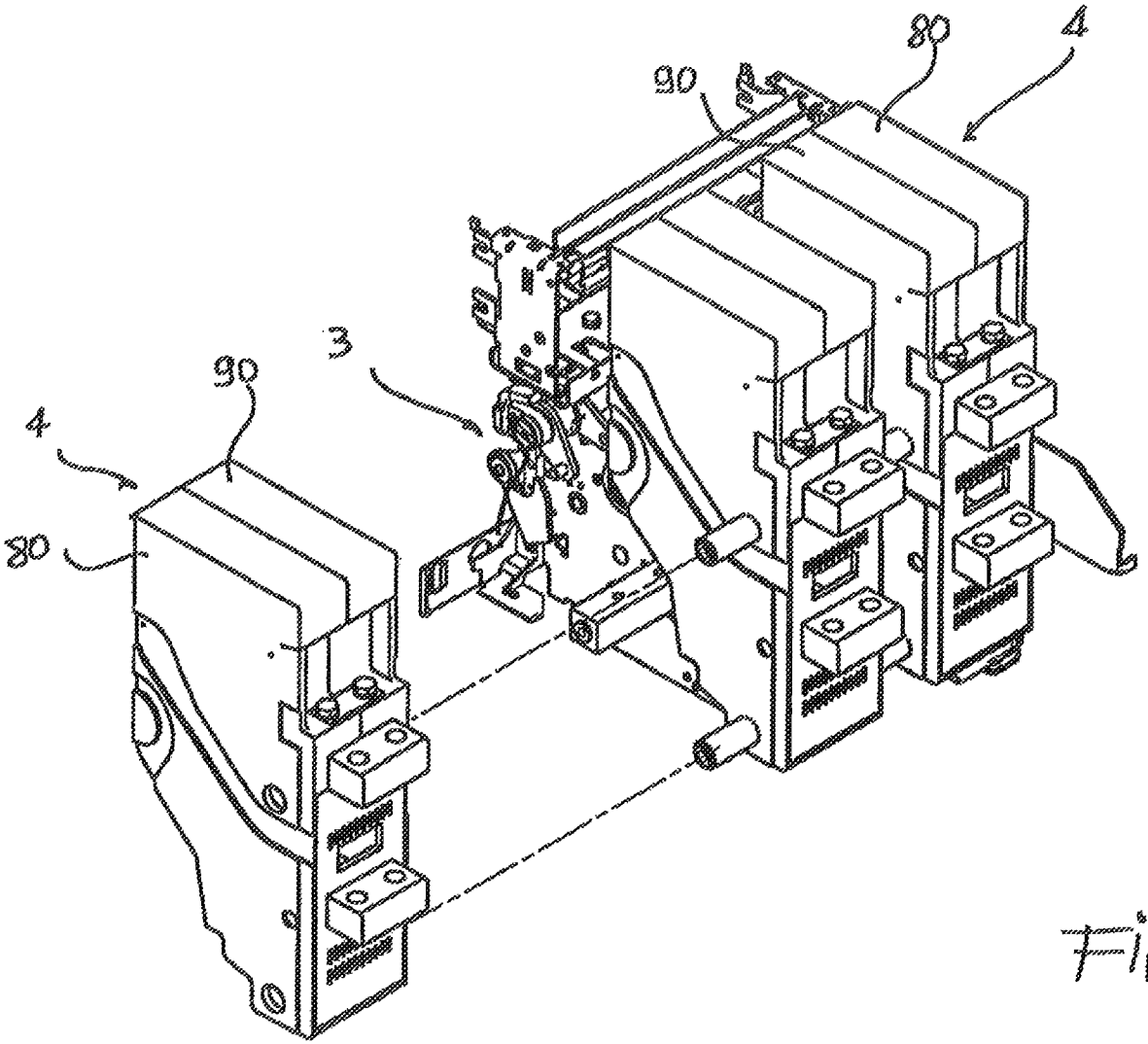
FIG. 4 is a partially exploded perspective view of several details of a circuit breaker according to the invention.

With reference to the attached figures, the low-voltage circuit breaker 1 according to the invention comprises a containment structure 2, with, for instance, sides, elements for closing the structure and elements for interfacing with the outside 21, 22, 23, as well as a front panel 24. The circuit breaker 1 also comprises a control mechanism 3 and a plurality of circuit breaking poles 4.

One of the characteristic features of the circuit breaker according to the invention is that said poles can be chosen from among at least two different types of pole. A first type of pole 40, that may be a pole in free air, for instance, comprises a first housing 41 containing a first fixed contact 42 and a corresponding first moving contact 43 that can be coupled to said first fixed contact 42 by rotating around an axis 45. A second type of pole 50, that may, for instance, be a pole in a controlled atmosphere (a vacuum or an extinguishing gas), comprises a second housing 51 containing a second fixed contact and a corresponding second moving contact that can be coupled to said second fixed contact by means of a translatory movement along an axis 55. The structure and characteristics of the poles are described in more detail below.

In the case of the poles 4 belonging to said first type of pole 40, the circuit breaker 1 according to the invention also comprises a first kinematic coupling 6 between the control mechanism 3 and said first moving contact 43, while in the case of the poles 4 belonging to said second type of pole 50, the circuit breaker 1 comprises a second kinematic coupling 7 between the control mechanism 3 and said second moving contact. The structure and characteristics of the kinematic couplings 6 and 7 are described in more detail below.

In practice, the circuit breaker according to the invention can be fitted with different types of pole depending on the needs of a given application, while the containment structure 2 and the control mechanism 3 remain substantially unchanged. This is translated into a considerable advantage, not only from the manufacturing point of view—in that it considerably increases the standardisation of the components, but also from the user's point of view because the flexibility and adaptability of the circuit breaker to the needs of the application are considerably increased.

This is made possible because the first 40 and the second 50 types of pole are modular and interchangeable with one another. The term modular is used here to mean that the structural design of the poles, whether they belong to the first or to the second type, has substantial similarities in terms of their shape, overall dimensions and interfacing with other parts inside and outside the circuit breaker.

As shown in the attached figures, preferably both the first housing 41 for the first type of pole 40, and the second housing 51 for the second type of pole 50, comprise a first and a second half-shell 80, 90.

The control mechanism 3 is not described in detail here because it can be of the conventional type. However, the control mechanism 3 preferably comprises a drive shaft that is connected to at least a first drive lever 30 for operatively connecting to one of said the kinematic couplings 6 or 7. In other words, the drive shaft and the corresponding drive lever 30 of the control mechanism 3 represent the interface between said control mechanism and the kinematic couplings, and constitute at least a first connection point 301 for connecting to one of said kinematic couplings 6 or 7.

Figure 7:
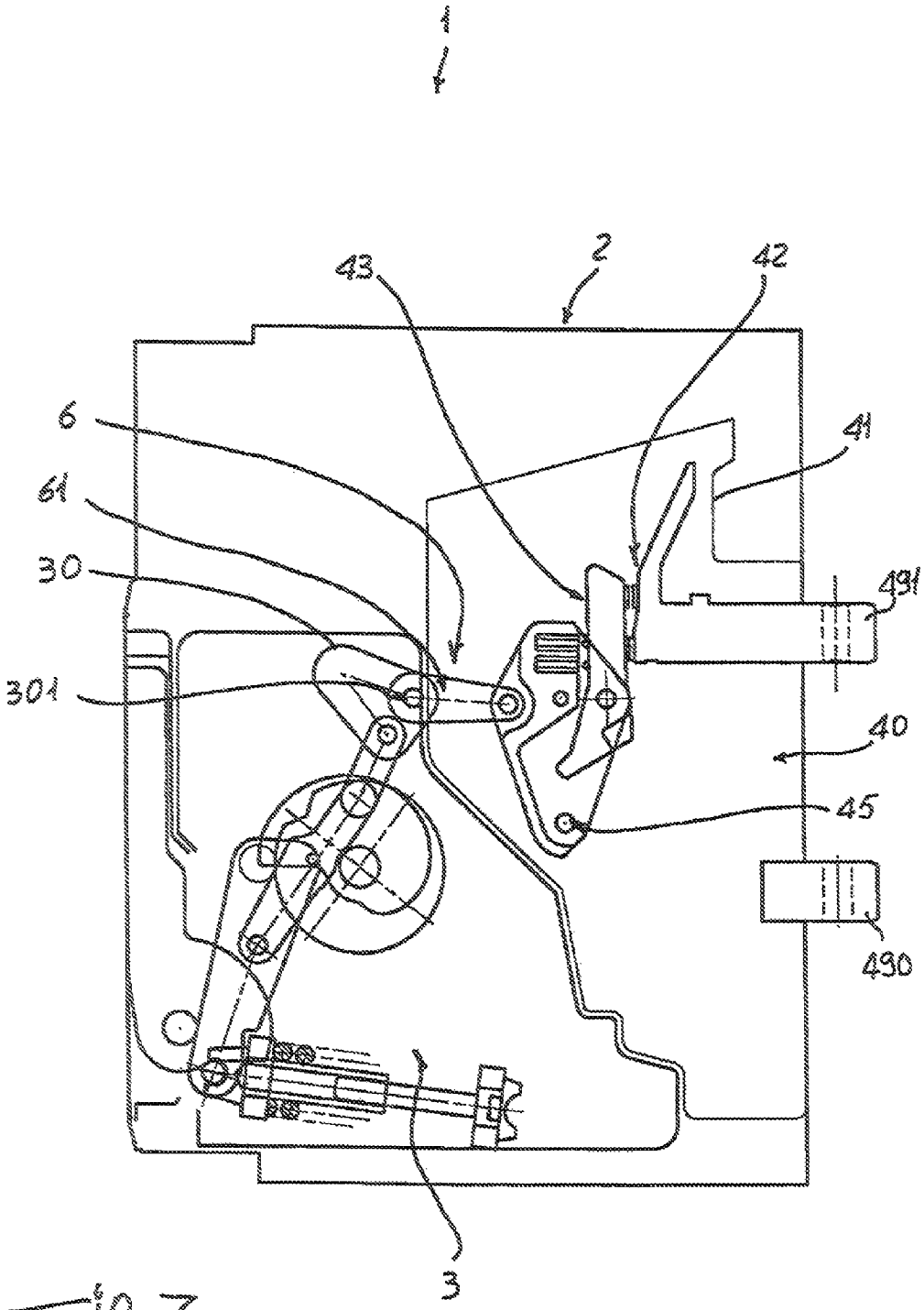
FIG. 7 is a cross-sectional view of a second embodiment of a circuit breaker according to the invention.
Figure 8:
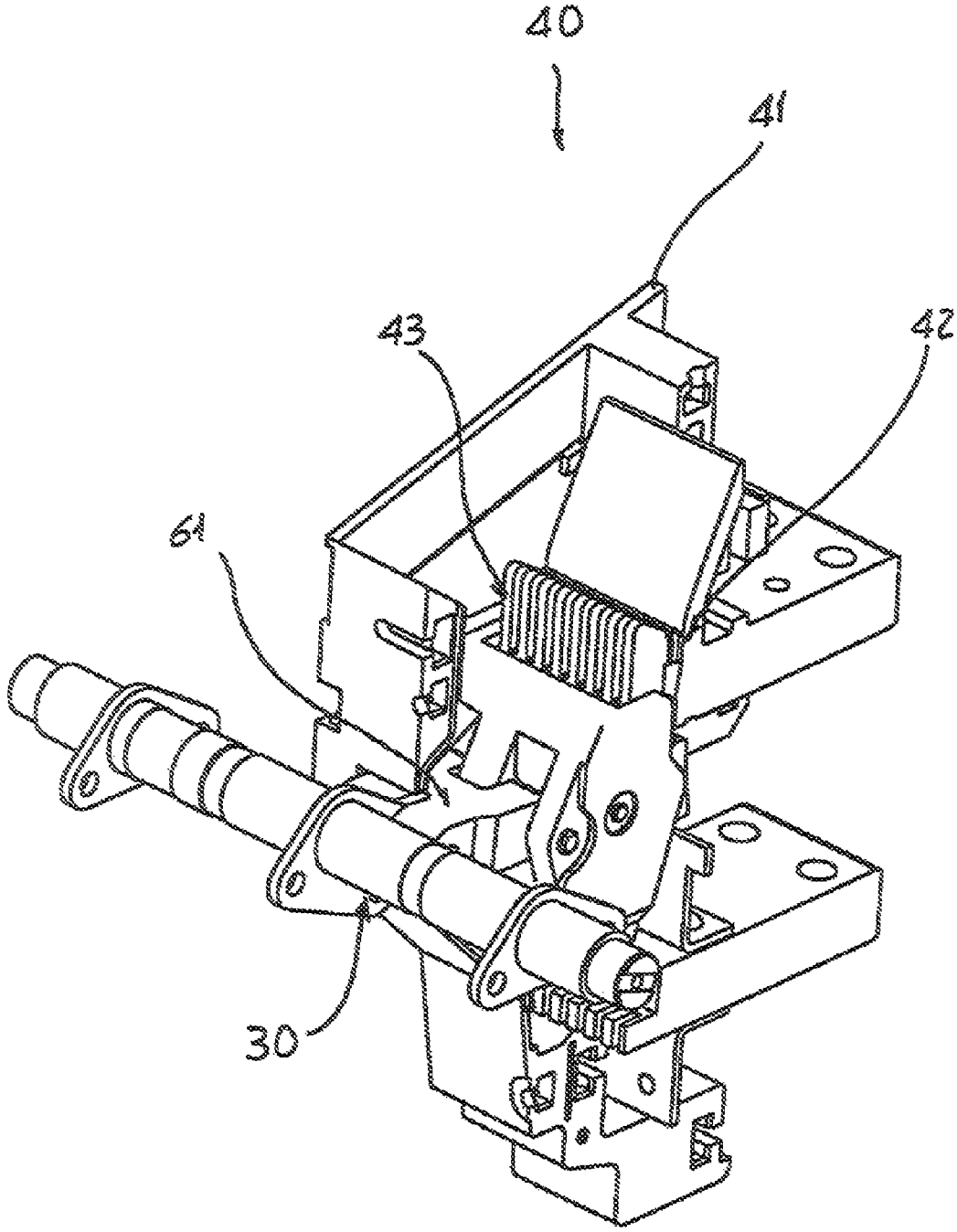
FIG. 8 is a partial perspective view of the pole and of the kinematic coupling used in the embodiment of the circuit breaker in FIG. 7.

In more detail, with reference to FIGS. 7 and 8, a possible embodiment of the circuit breaker 1 according to the invention involves the use of a first type of pole 40, e.g. isolated in free air. The poles 40, the stylised contours of the housing of which are shown in the drawing 41, are positioned at least partially inside the containment structure 2. The pole 40 comprises a fixed contact 42 and a moving contact 43, which can be mutually coupled and uncoupled by means of the rotation of the moving contact 43 around the pin 45. A control mechanism 3, of which the essential elements are represented, is also positioned at least partially inside the containment structure 2 and is operatively connected to the pole 40. The control mechanism 3 comprises a drive shaft which is connected to the drive lever 30 that serves as the interface with the first kinematic coupling 6. In the embodiment in FIGS. 7 and 8, the first kinematic coupling 6 consists in practical terms of a first connecting rod 61 connected to the first connection point 301 of the first drive lever 30 and to the first moving contact 43.

Thanks to the modular structure and standardisation of the components, the assembly of the circuit breaker 1 according to the invention is particularly straightforward. In practice, once the containment structure 2, the control mechanism 3, the poles 40 and the kinematic chain 6 have been prepared, the poles 40 are simply placed inside the containment structure 2 and the first connecting rod 61 is operatively connected to the first point 301 of the first drive lever 30 and to the first moving contact 43, then the circuit breaker is substantially assembled.

Figure 9:
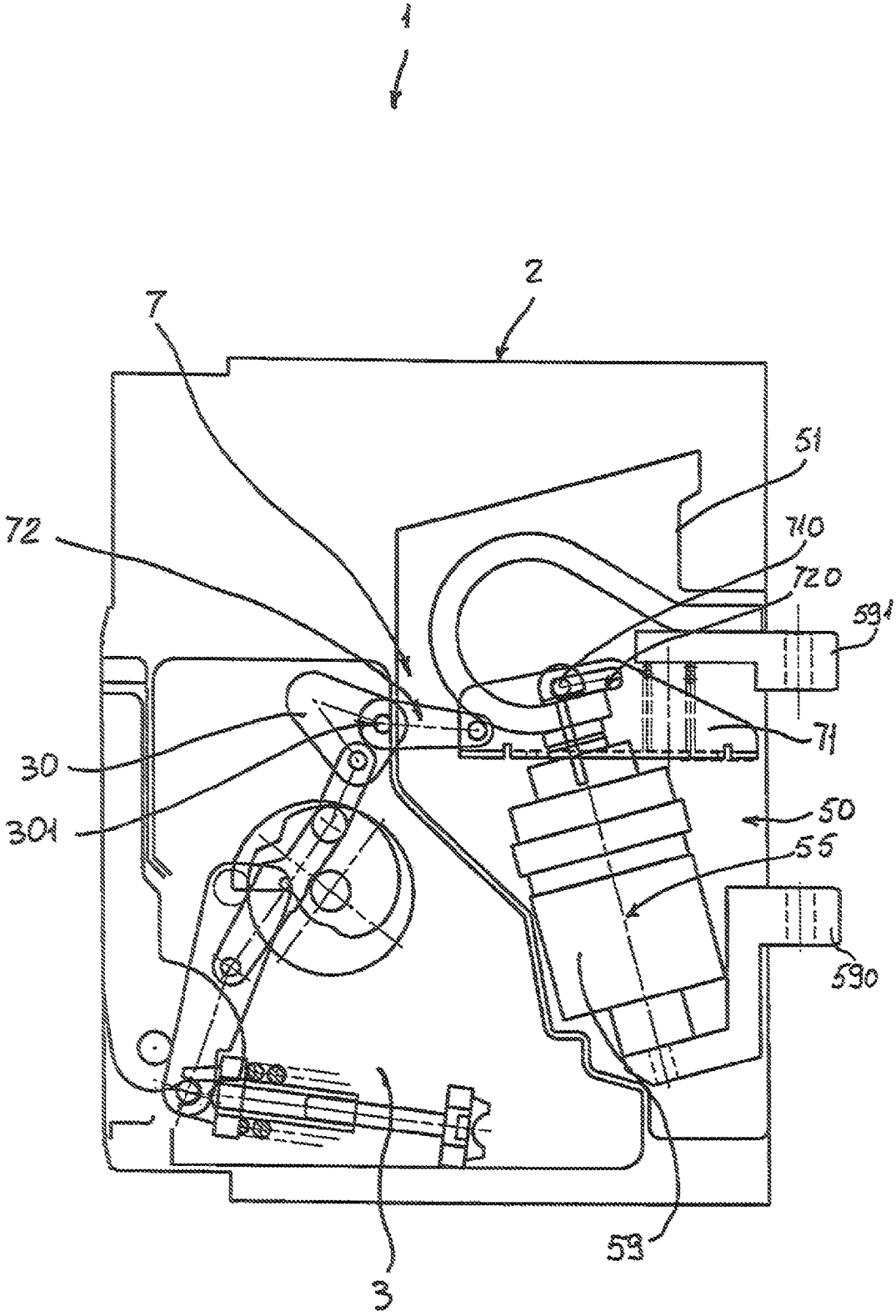
FIG. 9 is a cross-sectional view of a third embodiment of a circuit breaker according to the invention.
Figure 10:
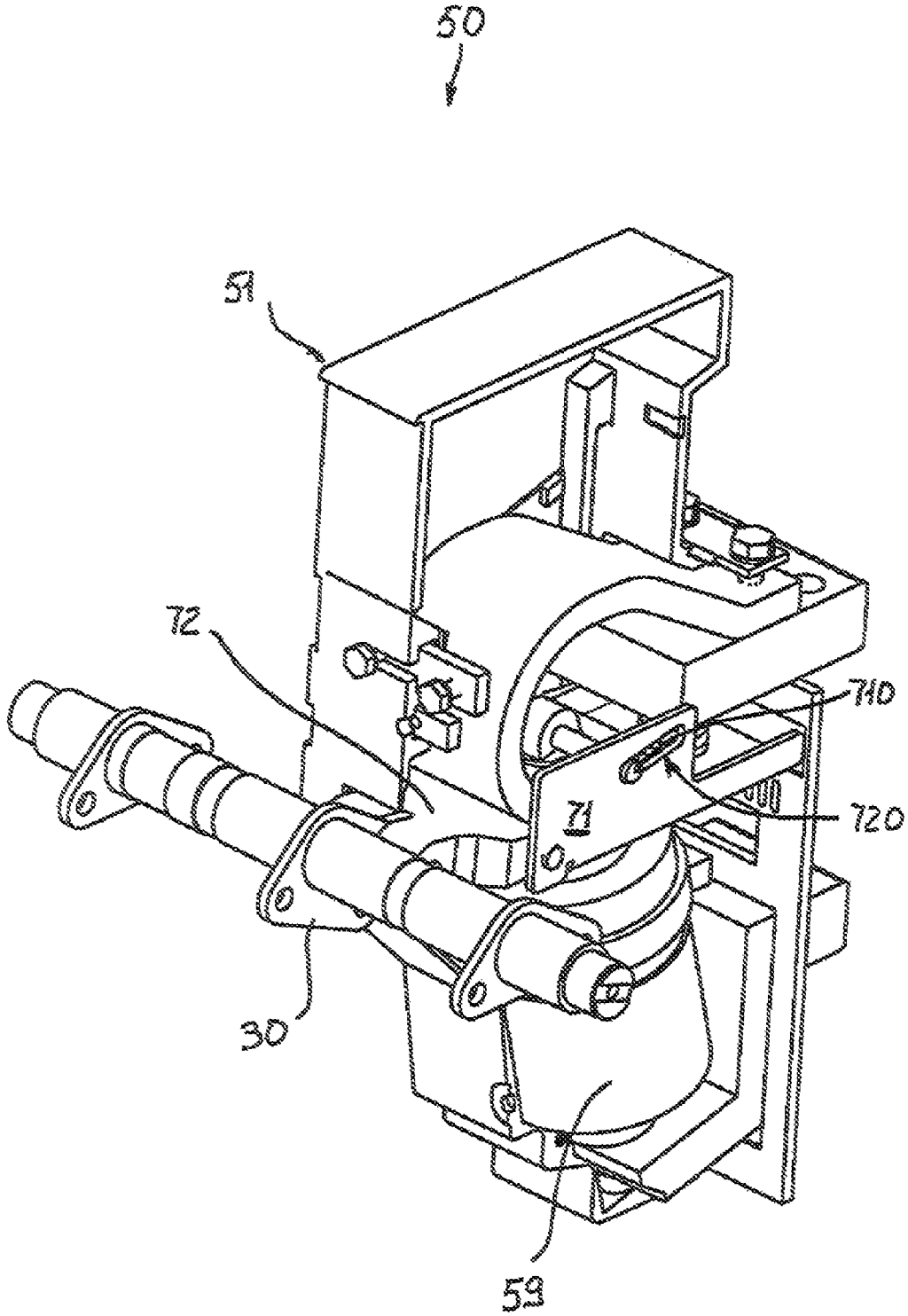
FIG. 10 is a partial perspective view of the pole and of the kinematic coupling used in the embodiment of the circuit breaker in FIG. 9.

As mentioned earlier, one of the particular features of the circuit breaker according to the invention lies in the opportunity to use different types of circuit breaking poles. With reference to FIGS. 9 and 10, another possible embodiment of the circuit breaker 1 according to the invention involves the use of a second type of pole 50, e.g. in a vacuum.

The pole 50, the stylised contours of the housing of which are shown in the drawing 51, are positioned at least partially inside the containment structure 2. The pole 50 comprises a fixed contact and a moving contact, not shown in the figure because they are inserted in the ampoule 59, suitable for being mutually coupled and uncoupled by means of a translatory movement of the moving contact along the axis 55. A control mechanism 3, of which the essential elements are represented, is also positioned at least partially inside the containment structure 2 and is operatively connected to the pole 50. The control mechanism 3 comprises a drive shaft that is connected to the drive lever 30 that forms the interface with the second kinematic coupling 7. In the embodiment in FIGS. 9 and 10, the second kinematic coupling 7 practically consists of a second connecting rod 72 connected to the first connection point 301 of the first drive lever 30 and to the saddle 71 for operating the second moving contact. In practical terms, with reference to FIG. 9, the saddle 71 moves in a substantially horizontal direction under the effect of the connecting rod 72; due to this translatory movement, the sloping plane of the slot 720 coming to bear on the pin 710 connected to the moving contact determines a displacement of the moving contact along the axis 55.

As emerges clearly from a comparison between FIGS. 7, 8 and 9, 10, the circuit breaker according to the invention can easily be converted from one type of pole to the other. In fact, the poles 40 and 50 are modular and interchangeable with one another, in the sense that the structural design of the housings 41 and 51 is basically the same, or at least adaptable to the same space; at the same time, the interfaces with the lever 30 of the control mechanism 3 (respectively involving the connecting rods 61 and 72) and with the outside environment (respectively by means of the terminals 490, 491 and 590, 590) are basically the same, or at least easily adaptable to the circumstances. To switch from the configuration with poles in free air in FIGS. 7, 8 to the configuration with poles in a vacuum in FIGS. 9, 10, it is consequently sufficient to disconnect the connecting rod 61 from the lever 30, substitute the pole 40 with the pole 50, in which provision has been made for the kinematic coupling 7—consisting of the connecting rod 72 and the saddle 71—and then connect the connecting rod 72 to the first point 301 of the drive lever 30 of the control mechanism 3. It is obviously also possible to implement this procedure in reverse.

In another aspect, the invention also relates to a method for replacing the poles of a low-voltage circuit breaker comprising a containment structure, a control mechanism, a first type of circuit breaking poles, and a first coupling mechanism between said control mechanism and said first type of circuit breaking poles; the method according to the invention is characterised in that it comprises the following stages:

disconnecting said first coupling mechanism from said control mechanism;

replacing said first type of poles with a second type of circuit breaking poles, and said first coupling mechanism with a second coupling mechanism;

connecting said second coupling mechanism to said control mechanism and to said second type of circuit breaking poles.

Of course, there is nothing to prevent action also being taken on other parts of the circuit breaker to make any changes required, e.g. substituting or integrating the propulsion members and/or electronic parts.

According to a particular embodiment, the first drive lever 30 comprises a first connection point 301 for connecting to the first kinematic coupling 6 and a second connection point 302 for connecting to the second kinematic coupling 7.

Figure 5:
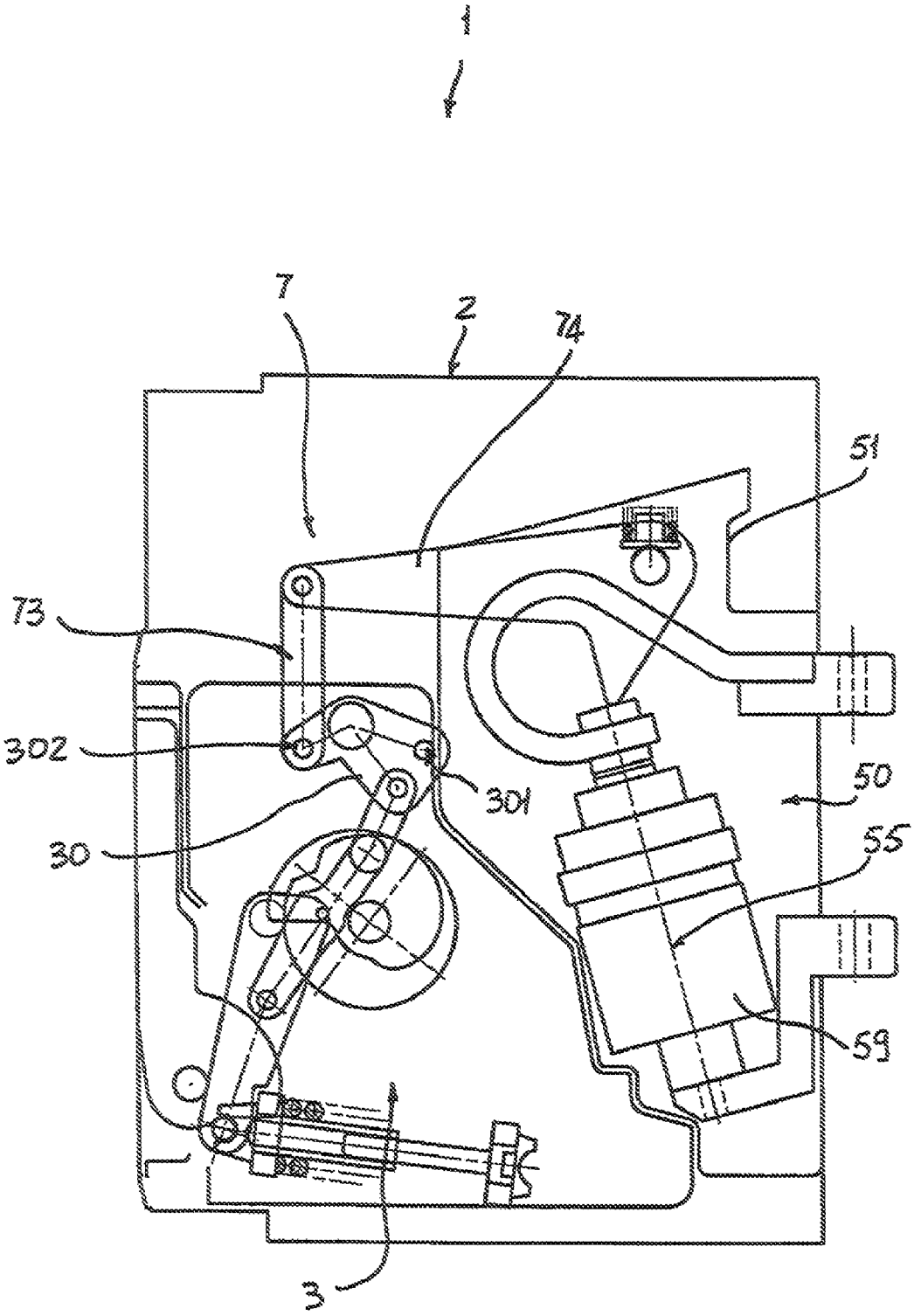
FIG. 5 is a cross-sectional view of a first embodiment of a circuit breaker according to the invention.
Figure 6:
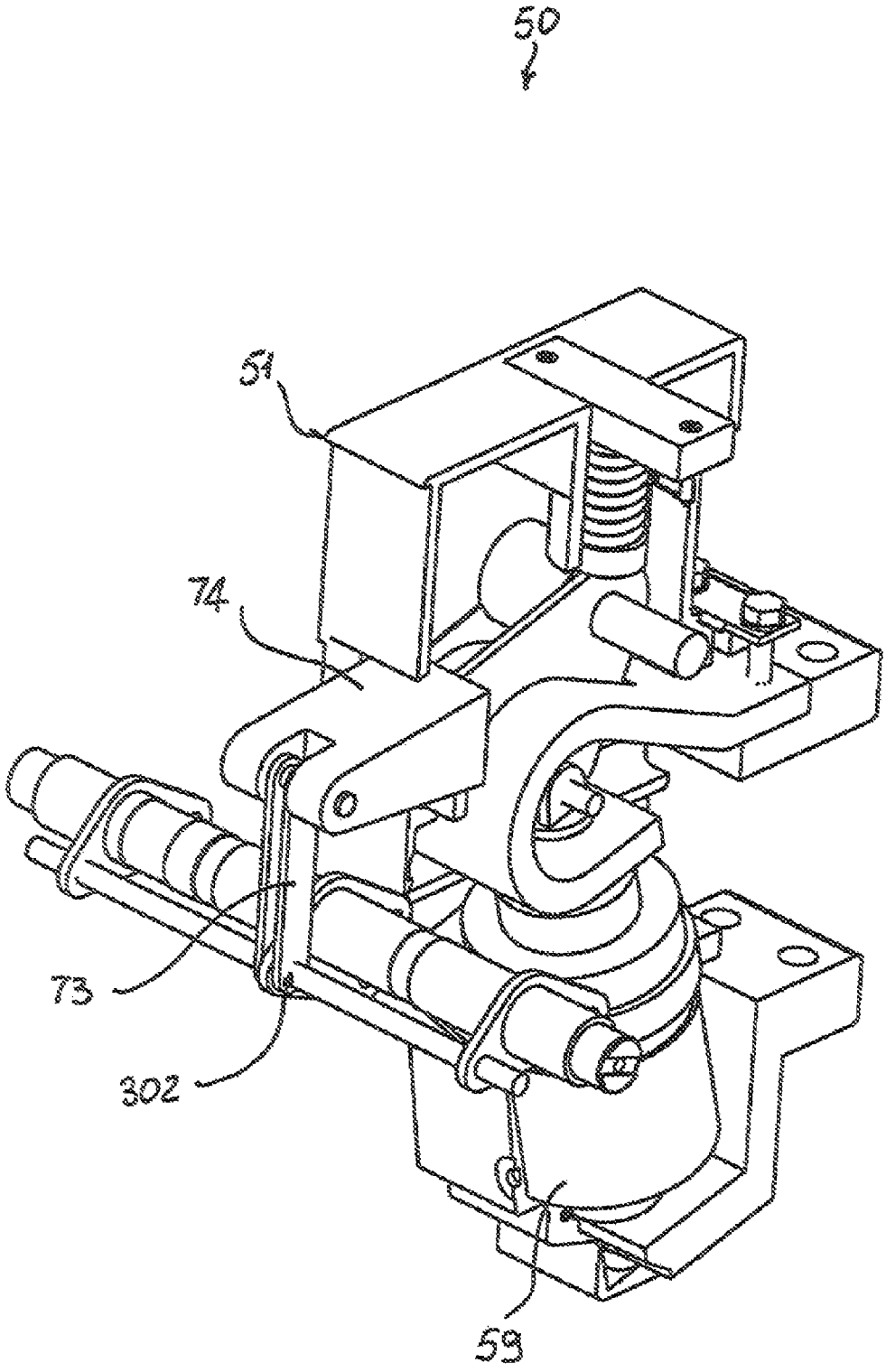
FIG. 6 is a partial perspective view of the pole and of the kinematic coupling used in the embodiment of the circuit breaker in FIG. 5.

In more detail, with reference to FIGS. 5 and 6, this embodiment of the circuit breaker 1 according to the invention involves the use of a type of pole 50, e.g. in a vacuum. The poles 50, the stylised contours of the housing of which are shown in the drawing 51, are positioned at least partially inside the containment structure 2. The pole 50 comprises a fixed contact and a moving contact, not shown in the figure because they are located inside the ampoule 59, suitable for being mutually coupled and uncoupled by means of a translatory movement of the moving contact along the axis 55. A control mechanism 3, of which the essential elements are represented, is also positioned at least partially inside the containment structure 2 and is operatively connected to the pole 50. The control mechanism 3 comprises a drive shaft that is connected to the drive lever 30 that provides the interface with the second kinematic coupling 7.

In the case illustrated, the first drive lever 30 comprises a first connection point 301 and a second connection point 302. In practical terms, the kinematic coupling 7 in this case consists of a third connecting rod 73 connected to the second connection point 302 of the first drive lever 30 and to a second lever 74 that is operatively connected to the second moving contact to induce its translatory movement along the axis 55.

Here again, as emerges from a comparison between FIGS. 5, 6 and 7, 8, the presence of two connection points 301 and 302 on the lever 30 facilitates the passage from one type of pole to the other. To switch from the configuration with poles in a vacuum in FIGS. 5, 6 to the configuration with poles in free air in FIGS. 7, 8, it is sufficient to disconnect the connecting rod 73 from the connection point 302 of the lever 30, to replace the pole 50 with the pole 40, in which provision has been made for the kinematic coupling 6—consisting of the connecting rod 61—and then to connect the connecting rod 61 to the first point 301 of the drive lever 30 of the control mechanism 3. Of course the reverse procedure is equally feasible, just as it is possible to switch to a pole with the same type of circuit breaking technology but a different kinematic coupling; for instance, it is easy to use a similar procedure to replace the poles and kinematic couplings in FIGS. 5, 6 with the poles and kinematic couplings in FIGS. 9, 10.

Based on the above description, it is evident that the low-voltage circuit breaker according to the invention achieves the previously stated aims and objects.

In the light of the description provided, other characteristics, modifications or improvements are feasible and may be evident to a person skilled in the art. Any such characteristics, modifications and improvements shall consequently be considered part of the present invention. In practical terms, any materials and any contingent sizes and shapes of the components may be used, according to need and the state of the art.

We claim:

1. A low-voltage circuit breaker comprising:

a containment structure;

a control mechanism;

a plurality of circuit breaking poles, chosen between a first type of pole and a second type of pole, said first type of pole comprising a first housing containing a first fixed contact and a corresponding first moving contact that can become coupled to said first fixed contact by rotating around a point, and said second type of pole comprising a second housing containing a second fixed contact and a corresponding second moving contact that can be coupled to said second fixed contact by means of a translatory movement along an axis;

a first kinematic coupling between said control mechanism and said first moving contact, in the case of said poles belonging to said first type of pole, or a second kinematic coupling between said control mechanism and said second moving contact, in the case of said poles belonging to said second type of pole, wherein said control mechanism comprises an interface for mechanical connection with said kinematic couplings.

2. The circuit breaker according to claim 1, wherein said first and said second types of pole are modular and interchangeable with one another.

3. The circuit breaker according to claim 1, wherein said first housing and said second housing comprise a first and second half-shell.

4. The circuit breaker according to claim 1, wherein said control mechanism comprises a drive shaft that is connected to a first drive lever operatively connected to one of said kinematic couplings.

5. The circuit breaker according to claim 4, wherein said first drive leaver comprises a first connection point for connecting to one of said kinematic couplings.

6. The circuit breaker according to claim 5, wherein in that said second kinematic coupling comprises a second connecting rod that connects said first drive lever to a first saddle for displacing said second moving contact.

7. The circuit breaker according to claim 4, wherein said first drive leaver comprises a first connection point for connecting to said first kinematic coupling and a second connection point for connecting to said second kinematic coupling.

8. The circuit breaker according to claim 7, wherein said second kinematic coupling comprises a third connecting rod that connects said first drive lever to a second lever for displacing said second moving contact.

9. The circuit breaker according to claim 4, wherein said first kinematic coupling comprises a first connecting rod that connects said first drive lever to said first moving contact.

10. A method for assembling a low-voltage circuit breaker, the method comprising:

preparing a containment structure for said circuit breaker;

preparing a control mechanism for said circuit breaker;

preparing a plurality of circuit breaking poles chosen between a first type of pole and a second type of pole, wherein said first type of pole comprises a first housing containing a first fixed contact and a corresponding first moving contact that can be coupled to said first fixed contact by means of its rotation around a point, and wherein said second type of pole comprises a second housing containing a second fixed contact and a corresponding second moving contact that can be coupled to said second fixed contact by means of a translatory movement along an axis;

preparing a first kinematic coupling between said control mechanism and said first moving contact;

preparing a second kinematic coupling between said control mechanism and said second moving contact;

placing said control mechanism and said plurality of poles inside said containment structure; and mechanically connecting the control mechanism to the poles by means of said first kinematic coupling, in the case of the poles belonging to said first type of pole, or by means of said second kinematic coupling, in the case of the poles belonging to said second type of pole, wherein said stage for the mechanical connection of the control mechanism to the poles comprises operatively connecting one of said kinematic couplings to an interface of said control mechanism.

11. The method according to claim 10, wherein said stage for the mechanical connection of the control mechanism to the poles comprises operatively connecting one of said kinematic couplings to a first drive lever of said control mechanism.

12. The method according to claim 11, wherein said stage for the mechanical connection of the control mechanism to the poles comprises operatively connecting a first connecting rod of said first kinematic coupling to a first point of said first drive lever and to said first moving contact.

13. The method according to claim 11, wherein said stage for the mechanical connection of the control mechanism to the poles comprises operatively connecting a second connecting rod of said second kinematic coupling to a first point of said first drive lever and to a first saddle for displacing said second moving contact.

14. The method according to claim 11, wherein said stage for the mechanical connection of the control mechanism to the poles comprises operatively connecting a third connecting rod of said second kinematic coupling to a second point of said first drive lever and to a second saddle for displacing said second moving contact.

15. A method for replacing the poles of a low-voltage circuit breaker comprising a containment structure, a control mechanism, a first type of circuit breaking poles, and a first mechanism for coupling said control mechanism with said first type of circuit breaking poles, characterized in that it comprises the following stages:

disconnecting said first coupling mechanism from said control mechanism, wherein said stage for the mechanical disconnection of the control mechanism to the first coupling mechanism comprises operatively disconnecting said first coupling mechanism from an interface of said control mechanism;

substituting said first type of poles with a second type of circuit breaking poles, and said first coupling mechanism with a second coupling mechanism;

connecting said second coupling mechanism to said control mechanism and to said second type of circuit breaking poles, wherein said stage for the mechanical connection of the control mechanism to the second coupling mechanism comprises operatively connecting said second coupling mechanism from the interface of said control mechanism.

* * * * *